US011302466B2

(12) United States Patent
Suzuki et al.

(10) Patent No.: US 11,302,466 B2
(45) Date of Patent: Apr. 12, 2022

(54) MULTILAYER COIL ELECTRONIC COMPONENT

(71) Applicant: TDK CORPORATION, Tokyo (JP)

(72) Inventors: Takashi Suzuki, Tokyo (JP); Hidekazu Sato, Tokyo (JP); Yusuke Nagai, Tokyo (JP); Kouichi Kakuda, Tokyo (JP); Kunihiko Kawasaki, Tokyo (JP); Shinichi Kondo, Tokyo (JP); Yuya Ishima, Tokyo (JP); Shinichi Sato, Tokyo (JP); Masaki Takahashi, Tokyo (JP); Takashi Endo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 686 days.

(21) Appl. No.: 16/199,047

(22) Filed: Nov. 23, 2018

(65) Prior Publication Data

US 2019/0198210 A1 Jun. 27, 2019

(30) Foreign Application Priority Data

Dec. 27, 2017 (JP) ..... JP2017-252185

(51) Int. Cl.

| | |
|---|---|
| ***H01F 1/147*** | (2006.01) |
| ***H01F 1/33*** | (2006.01) |
| ***H01F 27/28*** | (2006.01) |
| ***H01F 17/04*** | (2006.01) |
| ***H01F 17/00*** | (2006.01) |
| ***H01F 1/24*** | (2006.01) |
| ***H01F 1/26*** | (2006.01) |

(Continued)

(52) U.S. Cl.

CPC ..... *H01F 1/14766* (2013.01); *H01F 1/24* (2013.01); *H01F 1/26* (2013.01); *H01F 1/33* (2013.01); *H01F 17/0013* (2013.01); *H01F 17/04* (2013.01); *H01F 27/2804* (2013.01); *H01F 27/255* (2013.01); *H01F 27/292* (2013.01); *H01F 2027/2809* (2013.01); *Y10T 428/32* (2015.01)

(58) Field of Classification Search

None

See application file for complete search history.

(56) References Cited

U.S. PATENT DOCUMENTS 7,871,474 B2 * 1/2011 Unoki ..... B22F 1/02 148/104
10,607,756 B2 * 3/2020 Suzuki ..... H01F 1/14766

(Continued)

FOREIGN PATENT DOCUMENTS

CN 102610362 A 7/2012
CN 102693801 A 9/2012

(Continued)

*Primary Examiner* — Kevin M Bernatz

(74) *Attorney, Agent, or Firm* — Oliff PLC

(57) ABSTRACT

A multilayer coil electronic component having improved inductance L, Q, and strength, and which has an element in which a coil conductor and a magnetic element body are stacked. The magnetic element body includes soft magnetic metal particles and a resin. The resin fills a space between the soft magnetic metal particles. Each of soft magnetic metal particles has a soft magnetic metal particle core and an oxide film covering the soft magnetic metal particle core. A layer of the oxide film contacting the soft magnetic metal particle core is made of an oxide including Si.

13 Claims, 12 Drawing Sheets

(51) Int. Cl.
*H01F 27/29* (2006.01)
*H01F 27/255* (2006.01)

(56) References Cited

U.S. PATENT DOCUMENTS

| | | | | |
|---|---|---|---|---|
| 2002/0097124 | A1* | 7/2002 | Inoue | H01F 27/027 336/83 |
| 2003/0001718 | A1 | 1/2003 | Inoue et al. | |
| 2004/0207954 | A1 | 10/2004 | Inoue et al. | |
| 2004/0209120 | A1 | 10/2004 | Inoue et al. | |
| 2007/0196671 | A1* | 8/2007 | Kobayashi | B82Y 25/00 428/447 |
| 2012/0188046 | A1* | 7/2012 | Matsuura | H01F 27/29 336/199 |
| 2012/0274437 | A1* | 11/2012 | Matsuura | C22C 38/34 336/221 |
| 2012/0274438 | A1 | 11/2012 | Hachiya et al. | |
| 2013/0200972 | A1 | 8/2013 | Wada et al. | |
| 2014/0049348 | A1 | 2/2014 | Matsuura et al. | |
| 2014/0132383 | A1* | 5/2014 | Matsuura | C22C 38/18 336/83 |
| 2014/0139311 | A1 | 5/2014 | Matsuura et al. | |
| 2016/0163448 | A1 | 6/2016 | Matsuura et al. | |
| 2016/0225503 | A1* | 8/2016 | Taniguchi | H01F 1/14733 |
| 2016/0233019 | A1 | 8/2016 | Matsuura et al. | |
| 2016/0254082 | A1* | 9/2016 | Tanada | C22C 38/34 420/78 |
| 2016/0293308 | A1 | 10/2016 | Ryu et al. | |
| 2017/0162307 | A1* | 6/2017 | Ishida | B01J 13/08 |
| 2018/0315528 | A1* | 11/2018 | Nanbara | H01F 1/14766 |
| 2019/0210104 | A1* | 7/2019 | Yamaji | B22F 9/22 |
| 2020/0246867 | A1* | 8/2020 | Yamaji | H01F 1/20 |
| 2020/0316683 | A1* | 10/2020 | Takahashi | C22C 33/0207 |

FOREIGN PATENT DOCUMENTS

| | | | |
|---|---|---|---|
| CN | 102956342 | A | 3/2013 |
| CN | 104916392 | A | 9/2015 |
| JP | 2009-164402 | A | 7/2009 |
| JP | 2012-164959 | A | 8/2012 |
| JP | 2012-238840 | A | 12/2012 |
| JP | 2015-164174 | A | 9/2015 |
| JP | 2016-009859 | A | 1/2016 |
| JP | 2016-021510 | A | 2/2016 |
| JP | 2016-143700 | A | 8/2016 |
| JP | 2017-098484 | A | 6/2017 |
| KR | 10-2001-0098959 | A | 11/2001 |
| KR | 10-2016-0105324 | A | 9/2016 |
| KR | 10-2016-0117255 | A | 10/2016 |

* cited by examiner

MULTILAYER COIL ELECTRONIC COMPONENT

BACKGROUND OF THE INVENTION

The present invention relates to a multilayer coil electronic component.

As an electronic component used for a power circuit of various electronic devices such as mobile phones and the like, a coil electronic component such as trance, choke coil, inductor, and the like are known.

Such coil electronic component has a coil as an electric conductor placed around a magnetic body which exhibits predetermined magnetic properties. As the magnetic body, various materials can be used depending on the desired properties.

Recently, a soft magnetic metal material has been tested as the magnetic body to correspond to attain the coil electronic component having more compact size, lower loss, and higher frequency.

In case the soft magnetic metal material is used as the magnetic body of the coil electronic component, an insulation property of the soft magnetic metal material becomes a problem. Particularly, in case of the multilayer coil electronic component, the magnetic body directly contacting with the coil conductor, hence if the insulation property of the soft magnetic metal material is low, a short circuit may occur when a voltage is applied.

Further, if the soft magnetic metal material having low insulation property is used as a magnetic core of the electric power choke coil, an eddy current occurs to the soft magnetic metal particle, and a loss caused by the eddy current may occur.

Patent Document 1 discloses an invention relating to a multilayer inductor, and a resin is filled to a space between Fe—Si—Cr alloy particles. However, in the space between the Fe—Si—Cr alloy particles before filling the resin, there is only little space for filling the resin because Si oxides are present. Therefore, even if the resin is to be filled, only a small amount of the resin can be filled, hence an effect of filling the resin is small.

Patent Document 1: JP Patent Application Laid Open No. 2012-238840

SUMMARY

The present invention is attained in view of such circumstances, and the object is to provide a multilayer coil electronic component having improved inductance L, Q, and strength.

The multilayer coil electronic component according to the first aspect of the present invention has an element in which a coil conductor and a magnetic element body are laminated, wherein the magnetic element body includes soft magnetic metal particles and a resin, the resin fills a space between the soft magnetic metal particles, each of the soft magnetic metal particles has a soft magnetic metal particle core and an oxide film covering the soft magnetic metal particle core, and a layer of the oxide film contacting the soft magnetic metal particle core is made of an oxide including Si.

The multilayer coil electronic component according to the first aspect of the present invention satisfies the above characteristics, thereby attains a coil electronic component having excellent inductance L, Q, and strength.

The multilayer coil electronic component according to the first aspect of the present invention may have an average thickness of the oxide film of 5 nm or more and 60 nm or less.

The oxide including Si may be substantially included only in the oxide film.

The multilayer coil electronic component according to the second aspect of the present invention has an element in which a coil conductor and a magnetic element body are laminated, wherein the magnetic element body includes soft magnetic metal particles and a resin, the resin fills a space between the soft magnetic metal particles, a content of Fe is 92.5 mass % or more and 97.0 mass % or less, a content of Si is 3.0 mass % or more and 7.5 mass % or less, and Cr is substantially not included in the soft magnetic metal particles.

The multilayer coil electronic component according to the second aspect of the present invention satisfies the above characteristics, thereby attains a coil electronic component having excellent inductance L, Q, and strength.

The below described is common for both the first aspect of the invention and the second aspect of the invention.

An area ratio of the space may be 10.0% or more and 35.0% or less with respect to an entire SEM image obtained by observing a cross section of an interlayer part of the multilayer coil electronic component by SEM.

At an interlayer part of the multilayer coil electronic component, D50-D10 of the soft magnetic metal particles is 2.5 μm or less and D90-D50 may be 4.5 μm or less.

The soft magnetic metal particles may be Fe—Si alloy particles.

The resin may be a phenol resin or an epoxy resin.

A mass ratio of the resin may be 0.5 mass % or more and 3.0 mass % or less with respect to a total mass of the coil conductor and the magnetic element body.

DETAILED DESCRIPTION OF INVENTION

Hereinafter, the present invention is described based on embodiments shown in the figures.

Figure 1:
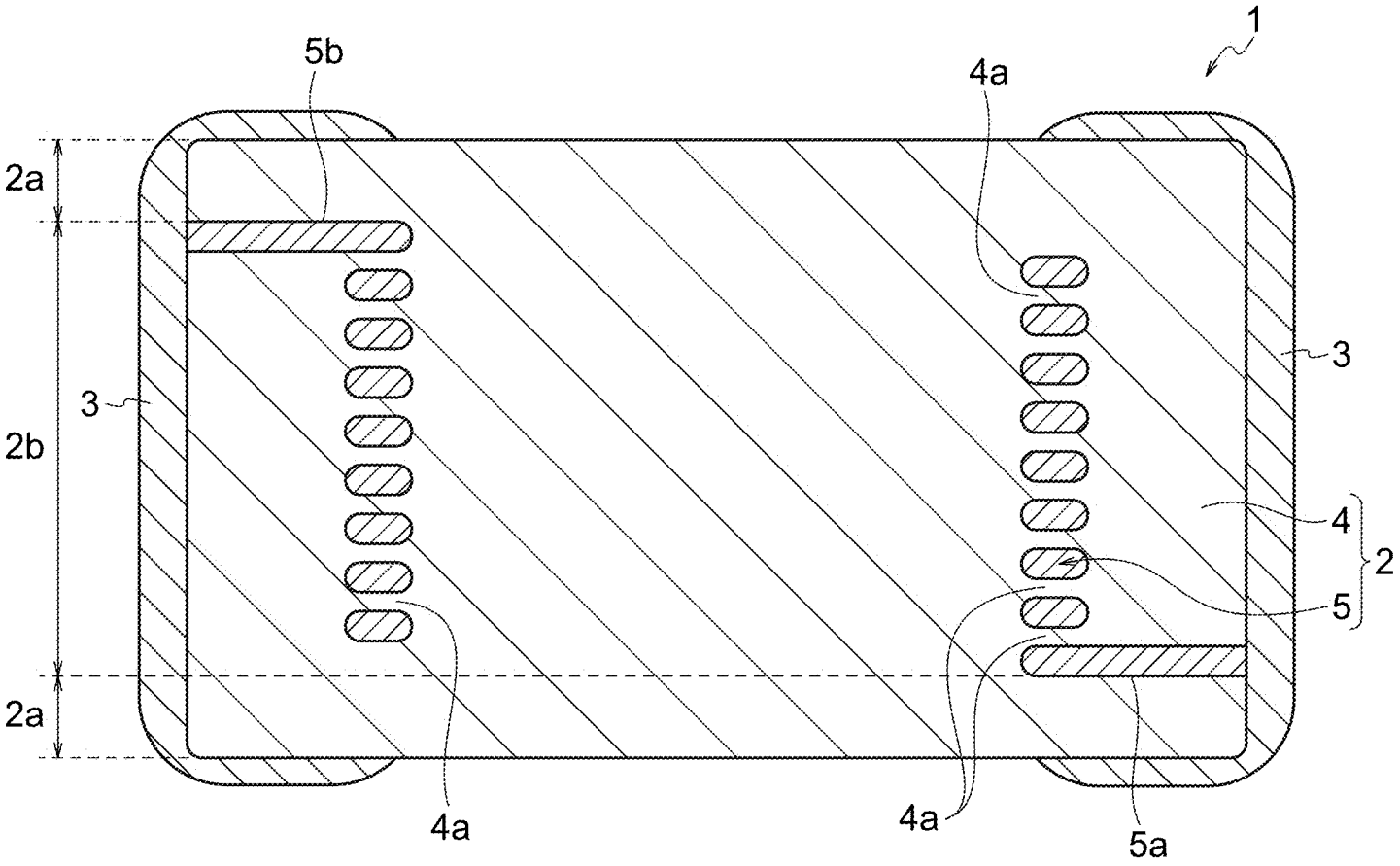
FIG. 1 is a multilayer inductor according to an embodiment of the present invention.

In the present embodiment, a multilayer inductor shown in FIG. 1 is used as an example of the multilayer coil electronic component.

As shown in FIG. 1, the multilayer inductor 1 according to the present embodiment has an element 2 and terminal electrodes 3. The element 2 has a constitution wherein a coil conductor 5 is three dimensionally and spirally embedded in a magnetic element body 4. At both ends of the element 2, the terminal electrodes 3 are formed, and these terminal electrodes 3 are connected to the coil conductor 5 through extracting electrodes 5*a* and 5*b*. Also, the element 2 is constituted from a center part 2*b* in which the coil conductor 5 is embedded, and a surface part 2*a* present at top and bottom in a stacking direction (z-axis direction) of the center part 2*b* and where the coil conductor 5 is not embedded. Also, in the magnetic element body 4 of the present embodiment, an interlayer part 4*a* is a space formed between one turn of spiral of the coil conductor 5.

The element 2 can be any shape, and usually it is a rectangular parallelepiped shape. Also, the size is not particularly limited, and it may be an appropriate size depending on the use. For example, the size can be 0.2 to 2.5 mm×0.1 to 2.0 mm×0.1 to 1.2 mm.

The material of the terminal electrodes 3 can be any material as long as it is an electrical conductor. For example, Ag, Cu, Au, Al, Ag alloy, Cu alloy, and the like may be used. Particularly, Ag is used preferably since it is inexpensive and has low resistance. The terminal electrodes 3 may include glass frit. Also, the surface of the terminal electrodes 3 may be plated. For example, Cu, Ni, and Sn plating may be carried out in this order, or Ni and Sn plating may be carried out in this order.

The material of coil conductor 5 and the extracting electrodes 5*a* and 5*b* can be any material as long as it is electrical conductor. For example, Ag, Cu, Au, Al, Ag alloy, Cu alloy, and the like may be used. Particularly, Ag is used preferably since it is inexpensive and has low resistance.

Figure 2:
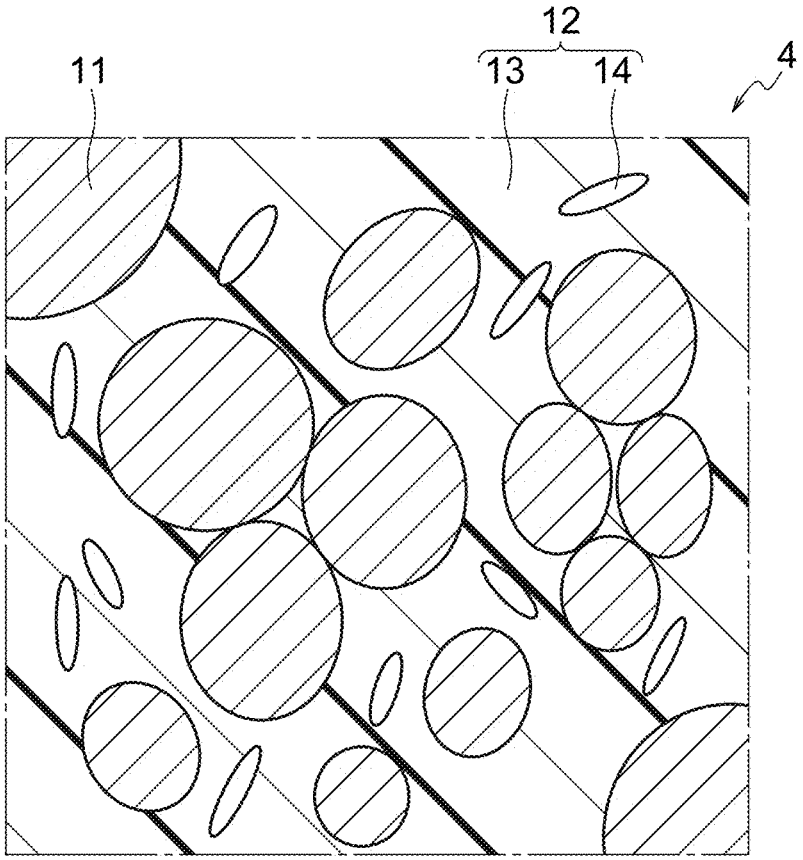
FIG. 2 is a cross section image of a magnetic element body of the multilayer inductor of FIG. 1.

The magnetic element body 4 includes soft magnetic metal particles 11 and a resin 13. FIG. 2 is a schematic image of a cross section of the magnetic element body 4. Also, in the magnetic element body 4, a space 12 is a part other than the soft magnetic metal particles 11. The resin 13 fills the space 12, and a part where the resin 13 is not filled is air space 14. Also, before the resin is filled, the space 12 is entirely air space 14.

Figure 11:
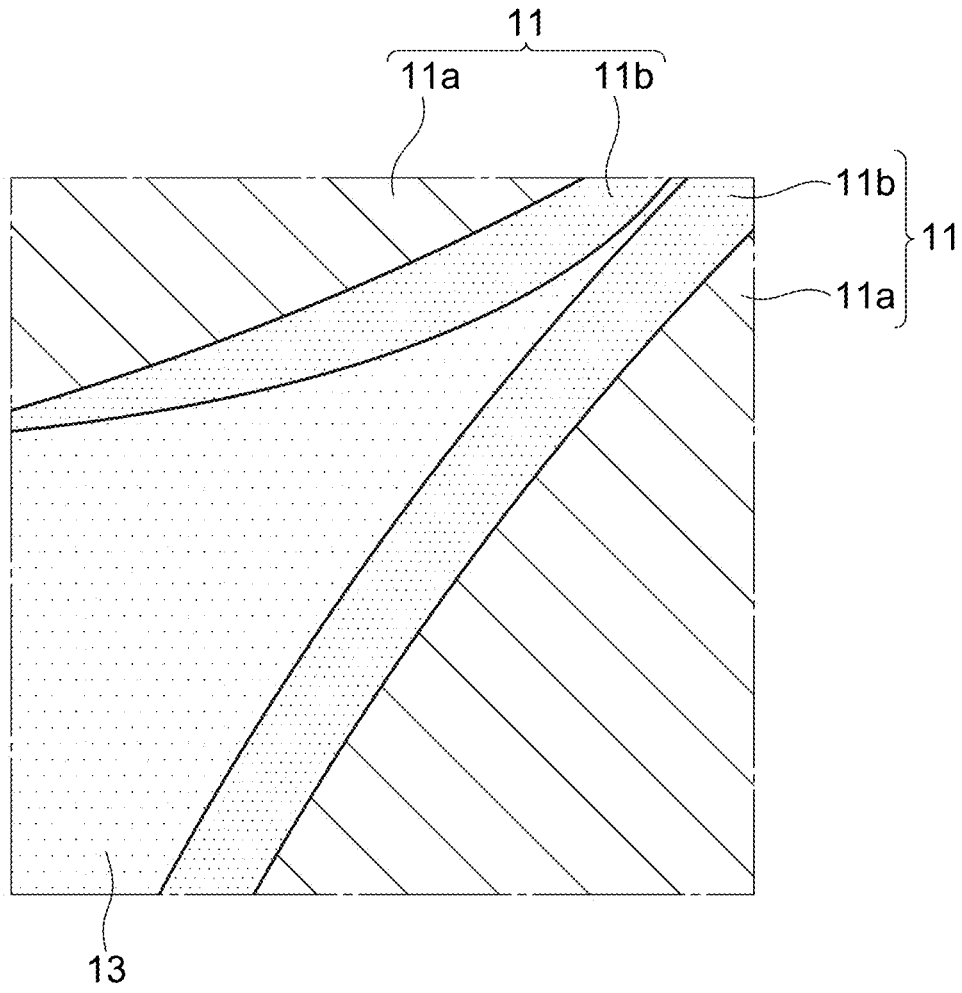
FIG. 11 is an enlarged schematic image of the interlayer part of Example 1.

As shown in FIG. 11 described in below, the soft magnetic metal particles 11 has a soft magnetic metal particle core 11*a* and an oxide film 11*b* covering the soft magnetic metal particle core 11*a*.

The material of the soft magnetic metal particle core 11*a* is not particularly limited. For example, the material of the soft magnetic metal particle core 11*a* may be the Fe—Si based alloy mainly including Fe and Si, or permalloy mainly including Fe, Ni, Si, and Co. The soft magnetic metal particle core 11*a* is preferably the Fe—Si based alloy.

When the soft magnetic metal particle core 11*a* is the Fe—Si based alloy, a content of Si in terms of Si is preferably 7.5 mass % or less with respect to 100 mass % of a total content of Fe and Si. That is, a content of Fe in terms of Fe is preferably 92.5 mass % or more.

In case the content of Si is too much, a molding property may deteriorate when molding is carried out using soft magnetic metal powder, and as a result, a fired density after firing tends to decrease. Further, an oxidation state of the fired alloy particle after a heat treatment cannot be maintained appropriately, and a magnetic permeability particularly tends to decrease.

Also, a content of Si in terms of Si is preferably 3.0 mass % or more with respect to 100 mass % of the total content of Fe and Si. That is, the content of Fe in terms of Fe is preferably 97.0 mass % or more.

When the content of Si is too small, the molding property improves, however the oxidation state of the soft magnetic particle after the sintering cannot be maintained appropriately, and a specific resistance tends to decrease.

In the Fe—Si based alloy according to the present embodiment, a content of other elements except for 0 is 0.15 mass % or less with respect to 100 mass % of the total content of Fe and Si. Further, Cr is not substantially included. Not substantially including Cr means that a content of Cr is 0.03 mass % or less. That is, in the present embodiment, the Fe—Si based alloy does not include Fe—Si—Cr alloy.

Also, the soft magnetic metal alloy according to the present embodiment may include P. In case the soft magnetic metal alloy is Fe—Si based alloy, 110 to 650 ppm of P is preferably included with respect to 100 mass % of the total content of Fe and Si. By including P in the soft magnetic metal alloy, the multilayer inductor capable of attaining a high specific resistance and predetermined magnetic properties can be obtained. Further, by including P within the above range, a specific resistance which is high but does not cause a short circuit in the magnetic element body 4 can be attained, for example a specific resistance of $1.0\times10^5$ Ω·cm or higher can be exhibited. Furthermore, the predetermined magnetic properties can be exhibited.

As possible reasons that the multilayer inductor 1 according to the present embodiment can have the above properties, for example following is considered. That is, when the Fe—Si alloy is heat treated while having predetermined amount of phosphor, the oxidation state of the soft magnetic metal particles 11 constituting the magnetic element body 4, namely a covering ratio, a thickness, and the like of the oxide film 11*b* can be controlled appropriately. As a result, the magnetic element body 4 after the heat treatment shows a high specific resistance, and also the predetermined magnetic properties can be exhibited. Therefore, the magnetic element body 4 according to the present embodiment is suitable as the magnetic element body which directly contacts with the coil conductor 5.

Note that, in case the soft magnetic metal particle core is permalloy, the content of Fe is preferably 45 to 60 mass %, the content of Ni is preferably 33 to 48 mass %, the content of Si is preferably 1 to 6 mass %, and the content of Co is preferably 1 to 6 mass % with respect to 100 mass % of a total content of Fe, Ni, Si, and Co. Further, the permalloy is substantially free of Cr. That is, the content of Cr is 0.06 mass % (600 ppm) or less with respect to 100 mass % of the total content of Fe, Ni, Si, and Co. Further, the maximum content of other elements excluding O such as P is 0.15 mass % (1500 ppm) or less.

Further, the oxide film 11*b* covering the soft magnetic metal particle core 11*a* according to the present embodiment preferably includes a layer formed of oxides including Si, and the soft magnetic metal particle core 11*a* and the layer formed of oxides including Si are preferably in contact. As the oxide film 11*b* covering the soft magnetic metal particle core 11*a* includes the layer formed of oxides including Si, the insulation property between the soft magnetic metal particles 11 increases, and Q improves. Also, as the oxide film 11*b* covering the soft magnetic metal particle core 11*a* includes the layer formed of compounds including Si, oxides of Fe are prevented from forming.

Any type of resin 13 can be used. Specifically, phenol resin or epoxy resin is preferable. In case the resin 13 is phenol resin or epoxy resin, it is particularly easy to fill the space 12. Also, the resin 13 is preferably a phenol resin since it is inexpensive and easy to handle.

The resin 13 fills the space 12, thereby the multilayer inductor 1 becomes stronger (particularly a bending strength). Also, the insulation property between the soft magnetic metal particles 11 increases and Q improves. Further, reliability and heat resistance improve.

Here, in the element 2 of the multilayer inductor 1, the interlayer part 4*a* is the part where the resin 13 is most difficult to fill in. Therefore, if the space 12 of the interlayer part 4*a* is filled with the resin 13, then the resin 13 is sufficiently filled to the entire element 2 of the multilayer inductor 1.

Any method can be used to verify whether the oxide film 11*b* covering the soft magnetic metal particle core 11*a* includes the layer formed of oxides including Si, and any method can be used to verify whether the space 12 is filled with the resin 13. For example, SEM-EDS measurement and STEM-EDS measurement can be carried out to visually verify whether the oxide film 11*b* covering the soft magnetic metal particle core 11*a* includes the layer formed of oxides including Si, and whether the space 12 is filled with the resin 13.

Figure 3:
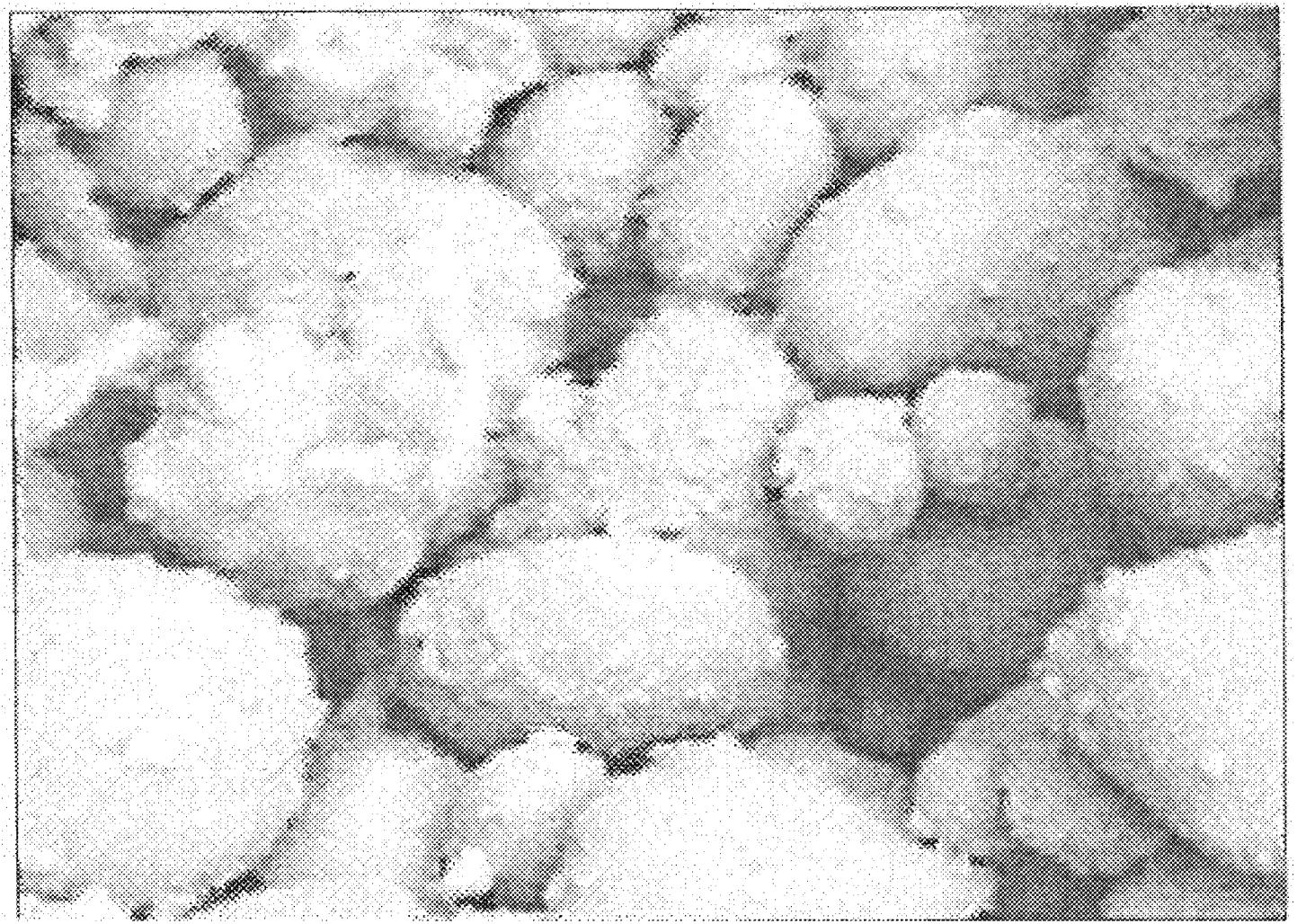
FIG. 3 is SEM image of a cross section of an interlayer part before filling the resin of Example 1.
Figure 4:
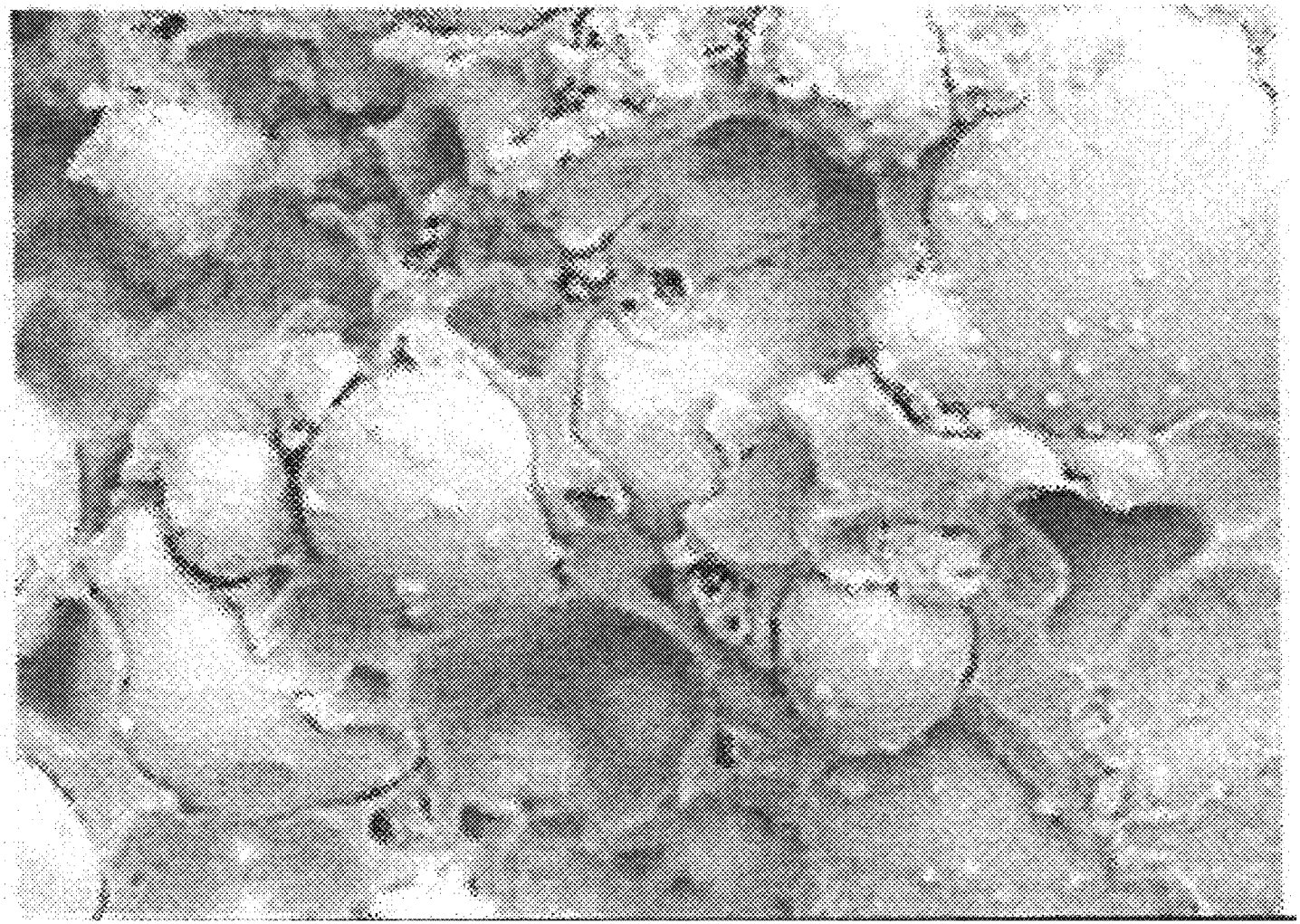
FIG. 4 is SEM image of a cross section of the interlayer part after filling the resin of Example 1.
Figure 5:
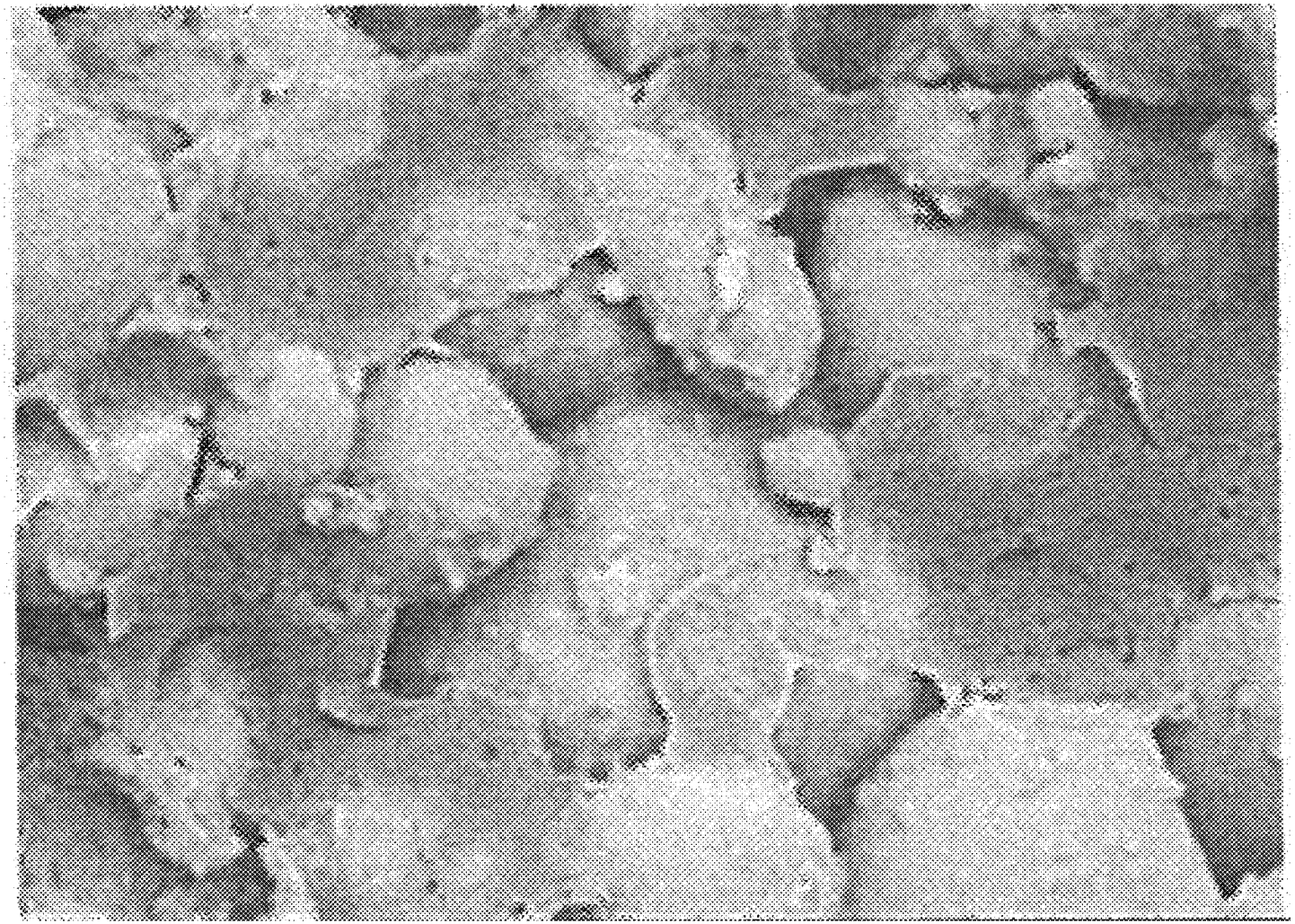
FIG. 5 is SEM image of the cross section of the interlayer part after plating of Example 1.
Figure 6:
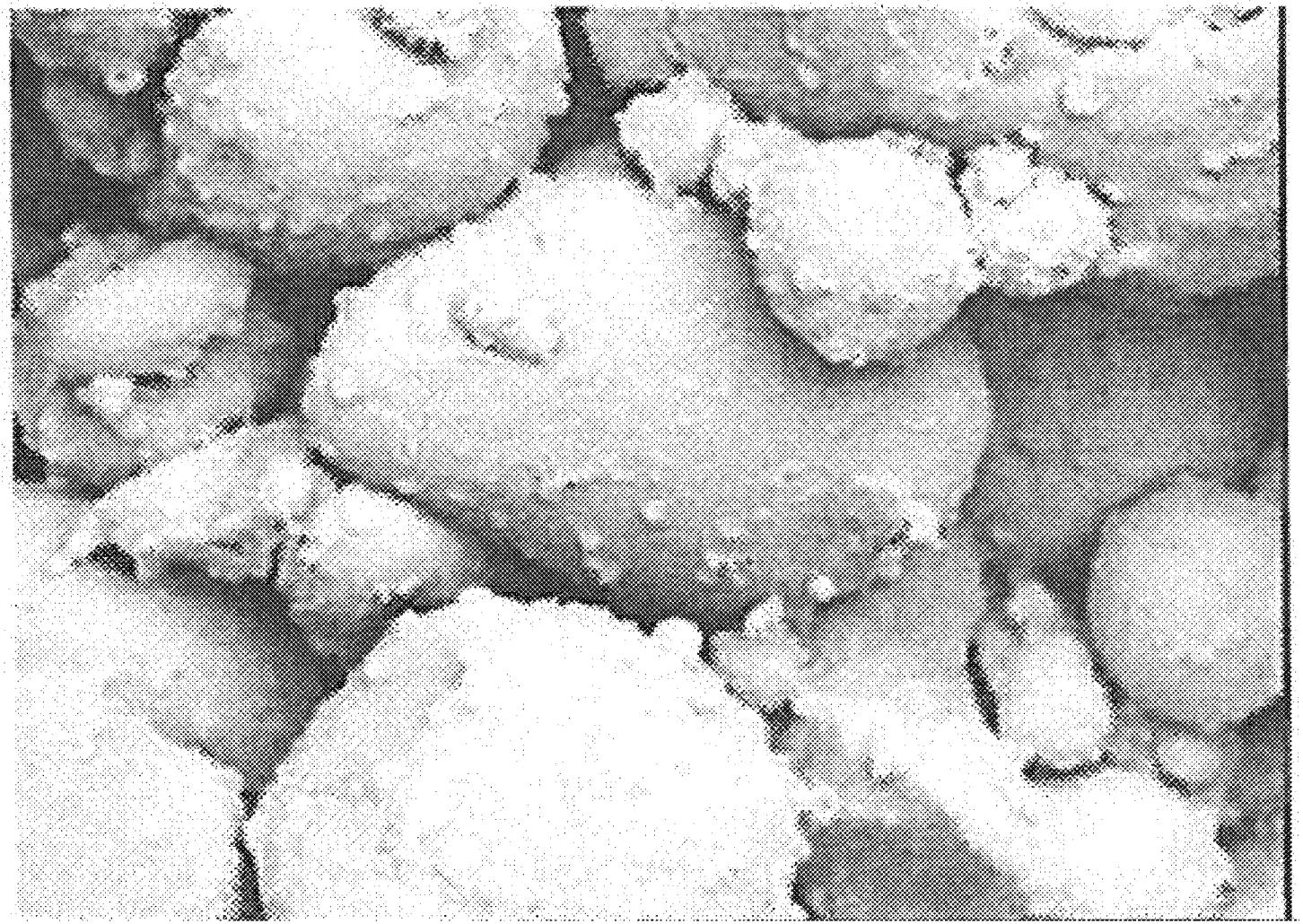
FIG. 6 is SEM image of the cross section of the interlayer part after plating of Comparative example 1.
Figure 7:
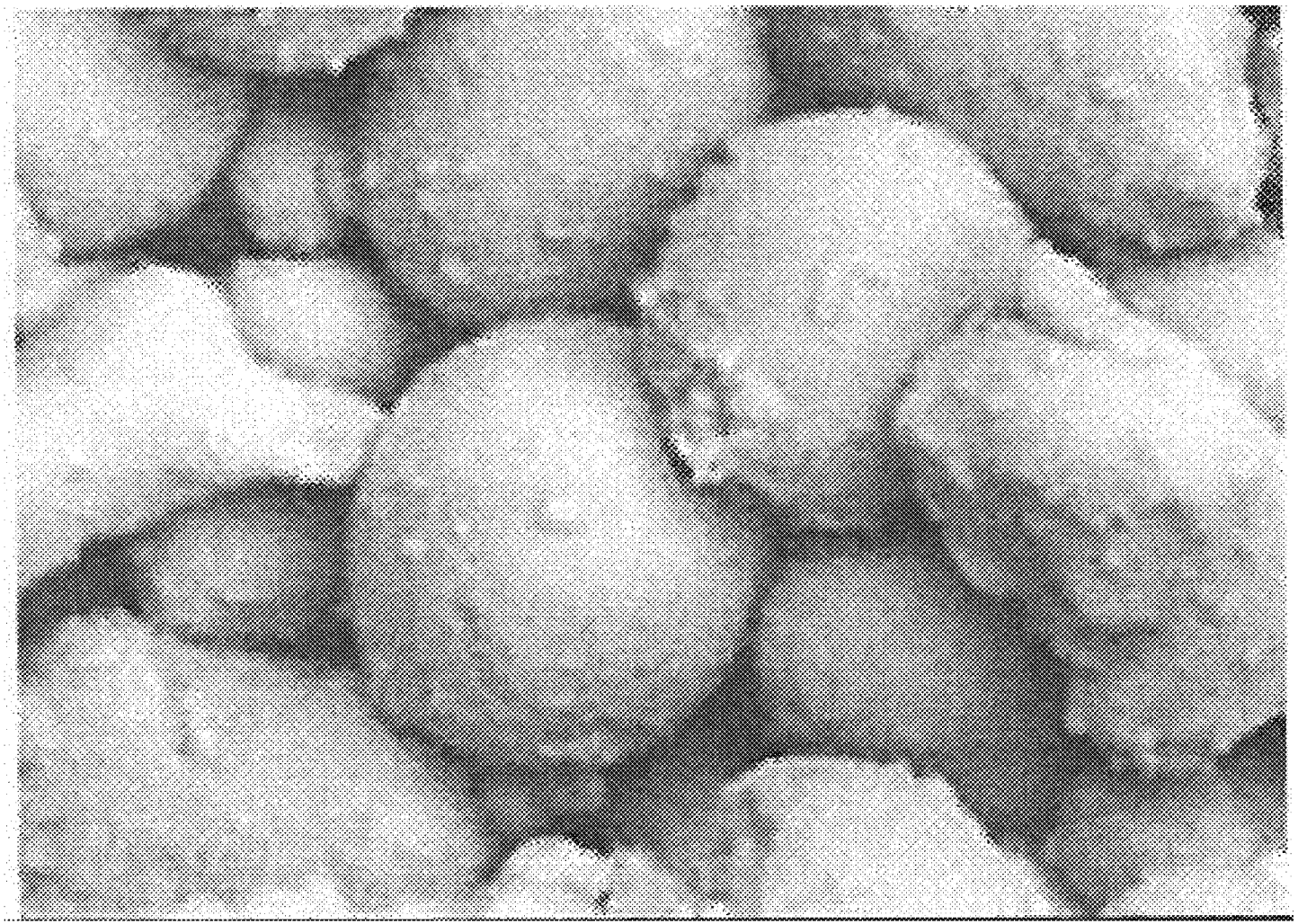
FIG. 7 is SEM image of a cross section of an interlayer part after filling the resin of Comparative example 1.
Figure 8:
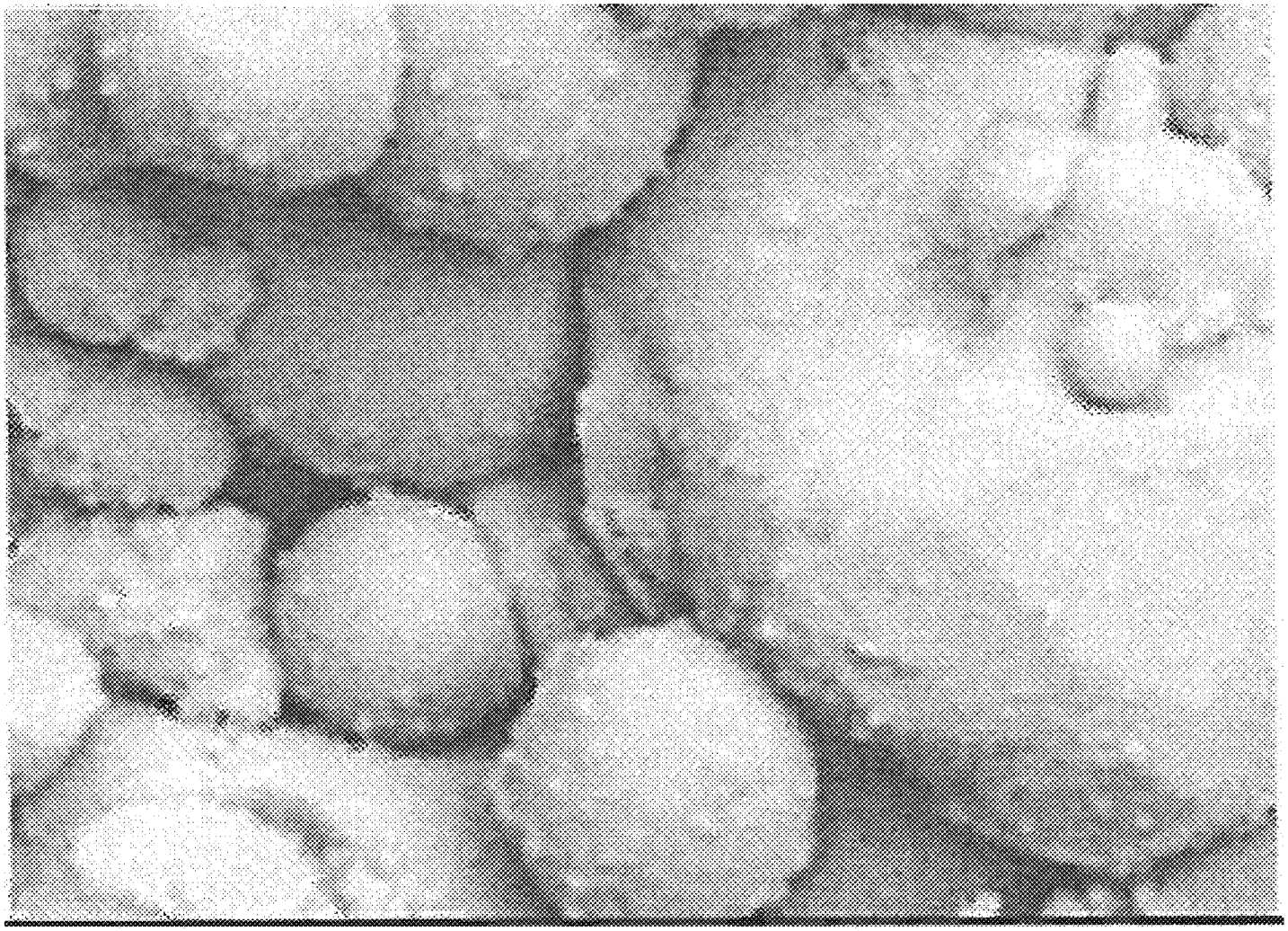
FIG. 8 is SEM image of the cross section of the interlayer part after plating in Comparative example 2.

Here, FIG. 3 to FIG. 5 show SEM images (10000× magnification) of the interlayer part of Example 1 described in below. FIG. 3 is SEM image before filling the resin, FIG. 4 is SEM image after filling the resin, and FIG. 5 is SEM image after plating the terminal electrodes after filling the resin. According to FIG. 4 and FIG. 5, it is apparent that the resin is present other than the soft magnetic metal particles, and the resin filled the space. On the contrary to this, FIG. 6 to FIG. 8 which are SEM images (10000× magnification) of the interlayer part of Comparative example 1 and Comparative example 2 which will be described in below. In FIG. 6 to FIG. 8, it is apparent that the space is not filled with the resin.

Figure 9:
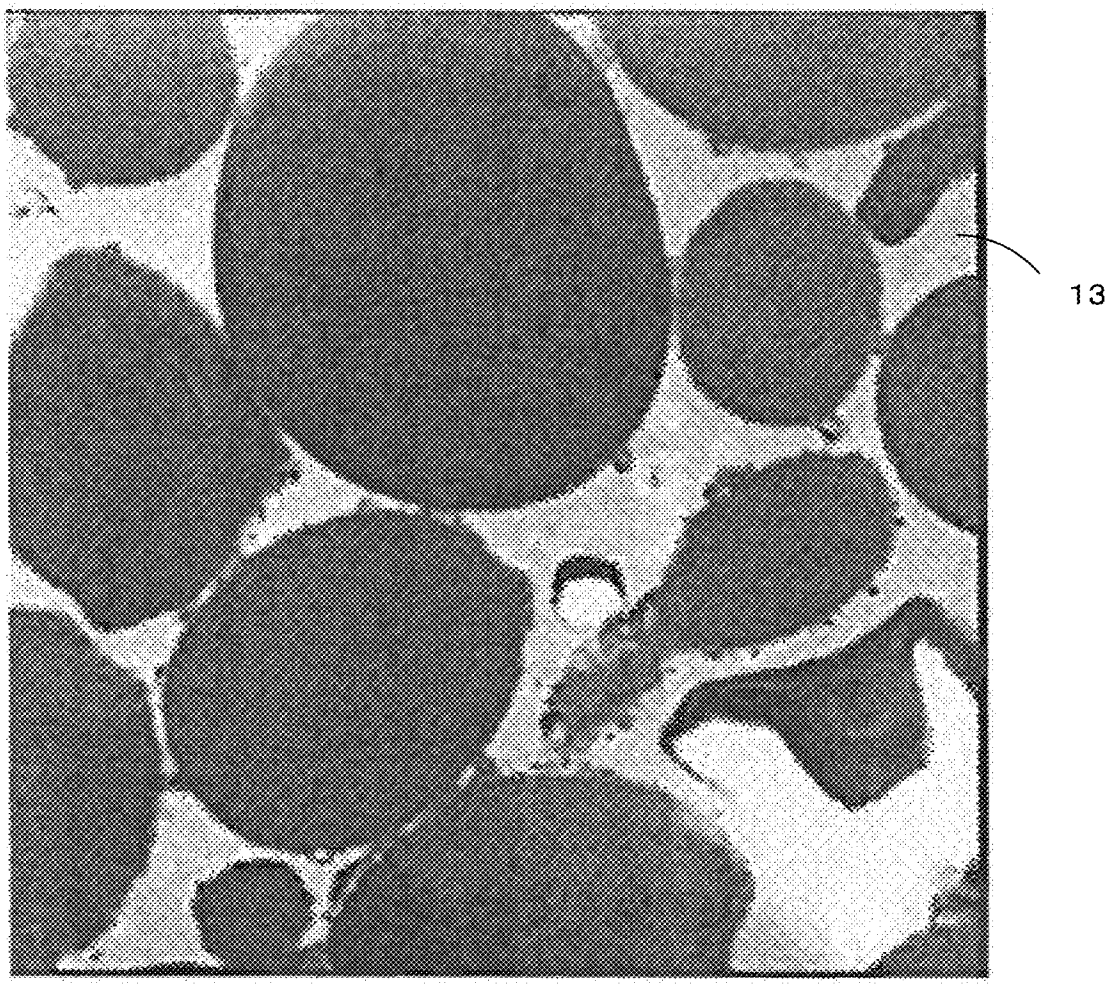
FIG. 9 is BF image of the interlayer part of Example 1.
Figure 10:
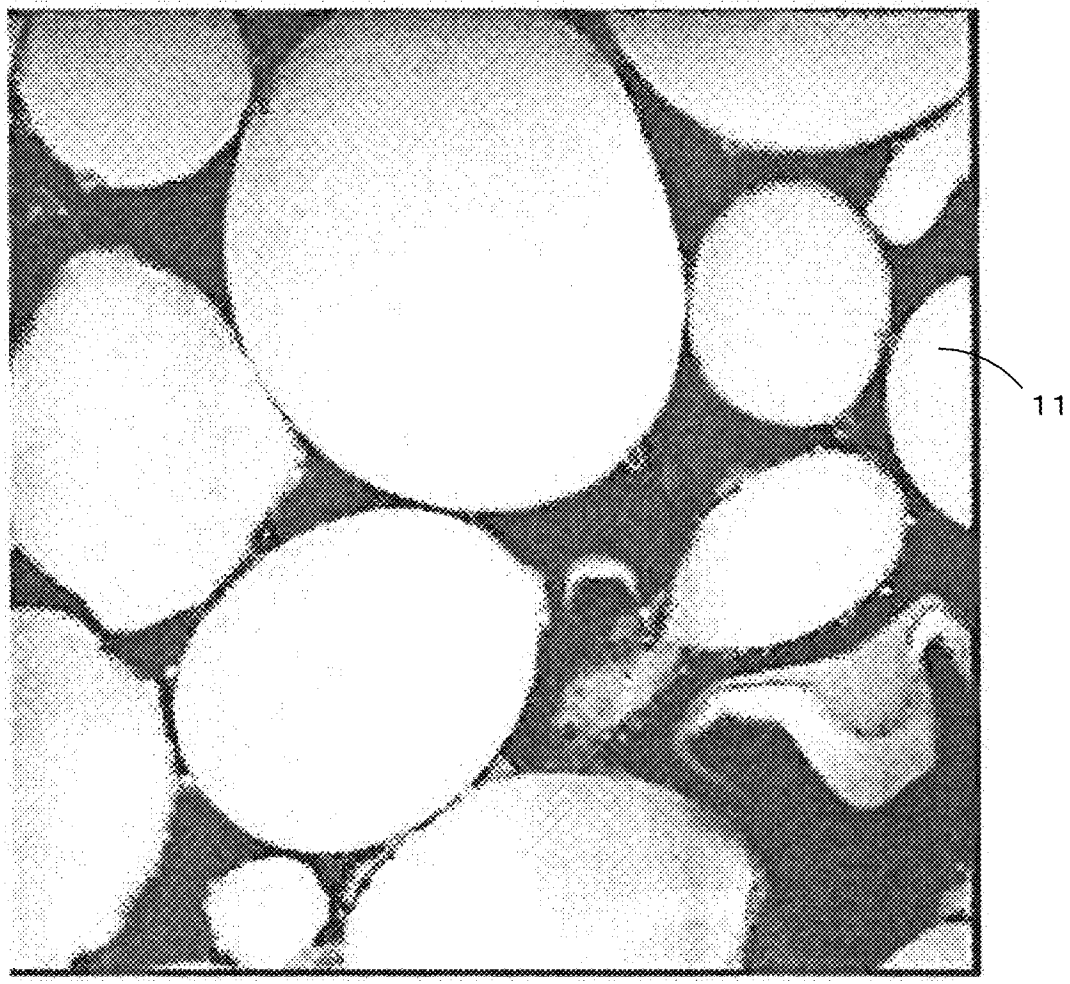
FIG. 10 is HADDF image of the interlayer part of Example 1.

Further, FIG. 9 and FIG. 10 show STEM-EDS measurement images (20000× magnification) of the interlayer part of a plated product of Example 1 discussed in below. FIG. 11 is an enlarged schematic image of the interlayer part of the plated product of Example 1 discussed in below. Note that, FIG. 9 and FIG. 10 show images after polishing the surface by a sand paper.

FIG. 9 is a bright field image (BF image) by STEM. FIG. 10 is a dark field image (HAADF image).

According to FIG. 9 and FIG. 10, the resin 13 fills the space 12 of the interlayer part, and also the resin is cured. Further, according to the element analysis by an image analysis and STEM-EDS, it is apparent that Si is substantially only present in the soft magnetic metal particles 11, and C is substantially only present in the space 12. Also, an area where C is present in the part other than the soft magnetic metal particles 11 may be defined as an entire area of the space 12 with respect to an entire observation field.

Also, as shown in FIG. 11, the oxide film 11*b* covering the soft magnetic metal particle core 11*a* is present. The oxide film 11*b* includes Si oxide layer. Further, according to the image analysis, Si is substantially present only in the soft magnetic metal particle core 11*a* and the oxide film 11*b*. Also, the oxide of Si is substantially present only in the oxide film 11*b*. Note that, the Si oxide layer 11*b* is a layer mainly made of the oxide of Si.

Also, the oxide film 11*b* can be any thickness. The oxide coating 11*b* can have any structure except that the Si oxide layer contacts with the soft magnetic metal particle core 11*a*. For example, the oxide film 11*b* may be made only from the Si oxide layer, or it may be a multilayer structure having Si oxide layer and other oxide layer. The Si oxide layer contacting the soft magnetic metal particle core 11*a* may be substantially made only from the oxide of Si. The thickness of the oxide film 111*b* and the thickness of each layer can be measured using STEM-EDS measurement image. In the present embodiment, the average thickness of the entire oxide film 11*b* is preferably 5 nm or more and 60 nm or less. Note that, the above average thickness is obtained by measuring the thickness of the oxide film 11*b* of at least 50 soft magnetic metal particles 11, and then by taking the average thereof. Note that, the oxide film 11*b* can be formed by any method. For example, it can be formed by firing the soft magnetic metal powder. Also, the thickness of the oxide film 11*b* and the thickness of each oxide layer can be controlled by a firing condition such as firing temperature, firing time, and the like, and also by the anneal condition as well. Note that, as the oxide film 11*b* becomes thicker, the space 12 becomes smaller, thus the filling amount of the resin 13 decreases. Note that, the oxide of Si is included substantially only in the oxide film 11*b*, and preferably it is not present in an area (space 12) which is at further outside than the oxide film 11*b* and between two soft magnetic metal particles 11.

In the multilayer inductor 1 according to the present embodiment, the soft magnetic material (soft magnetic metal particle 11), which constitutes the magnetic element body 4, has a high specific resistance. This is because the soft magnetic metal particle core 11*a* is covered by the oxide film 11*b*. Further, the space 12 is filled with the resin 13. Therefore, the plating solution scarcely enters in the space 12. Therefore, a high inductance L can be attained without having short circuit even after the plating. Further, predetermined properties can be attained such as improved strength (particularly the bending strength) of the multilayer inductor 1.

The average particle size (D50) of the soft magnetic metal particle 11 is not particularly limited. Also, the surface part 2*a* and the center part 2*b* may have different particle sizes. The soft magnetic metal particles 11 at the center part 2*b* preferably have a smaller D50 than D50 of the soft magnetic metal particle 11 at the surface part 2*a* from the point of improving reliability. For example, the soft magnetic metal particles 11 at the center part 2*b* preferably have D50 of 1.0 to 10 and the soft magnetic metal particles 11 at the surface part 2*a* preferably have D50 of 2.0 to 18 μm.

Also, the particle size of the soft magnetic metal particle 11 preferably varies little, because the space 12 becomes larger and the resin can be filled more. Specifically, varying little means that D50-D10 and D90-D10 are small. For example, D50-D10 at the center part 2*b* may be 0.5 μm or more and 3.0 μm or less, and D90-D50 may be 1.5 μm or more and 4.5 μm or less. Also, D50-D10 at the surface part 2*a* may be 4.0 μm or more and 6.0 μm or less, and D90-D50 may be 7.0 μm or more and 12.0 μm or less. Note that, the lower limit of the above D50-D10 and the lower limit of D90-D50 are mere examples. Further, when preparing the soft magnetic metal particles 11 having small D50-D10 and D90-D10, the effect attained by making the variation small decreases, but the cost increases.

There is no particular limit for a method of calculating D10, D50, and D90. For example, the area of the soft magnetic metal particles 11 may be calculated from an image analysis by observing the cross section with SEM, and the value calculated as the diameter of the circle corresponding to that area (circle equivalent diameter) is defined as the particle diameter. Then, the particle diameters of 100 or more of the soft magnetic metal particles 11 are calculated for each measuring point, then D10, D50, and D90 are calculated. Note that, the soft magnetic metal particle 11 can be any shape.

Also, the area ratio of the space 12 at the cross section of the interlayer part 4*a* (center part 2*b*) is preferably 10.0% or more and 35.0% or less with respect to the entire SEM observation image. The area ratio of the space 12 can be controlled by a particle size distribution of the soft magnetic metal particles, and also it can be controlled by an amount of a resin in the binder resin of a green chip, a molding pressure, a firing condition, and a anneal condition when forming the green chip. Also, if the particle size distribution of the soft magnetic metal particles is about the same, the space becomes wide, and as the amount of resin filled increases, the inductance L decreases, Q, and the bending strength tends to increase.

Next, an example of a method of producing the above multilayer inductor is described. First, a method of procuring the soft magnetic metal powder which is a material of the soft magnetic metal particles constituting the magnetic element body is described. In the present embodiment, the soft magnetic metal powder can be obtained using a same method as a known method of producing the soft magnetic metal powder. Specifically, it can be produced using a gas atomizing method, a water atomizing method, a rotating disk method, and the like. Among these, a water atomizing method is preferable since the soft magnetic metal powder having desirable magnetic properties can be easily obtained. Further, by controlling the particle size of the soft magnetic metal powder, D10, D50, and D90 of the soft magnetic metal particles obtained at the end can be controlled as well.

In a water atomizing method, a melted material (molten metal) is supplied as continuous fluid in a line form through a nozzle provided at a bottom of a crucible. High pressure water is applied to the supplied molten metal, and the molten metal is formed into a droplet form, and it is rapidly cooled to obtain fine powder.

In the present embodiment, the material of Fe and the material of Si are melted, and P is further added, then the water atomizing method is carried out to obtain fine powder, thereby the soft magnetic metal powder according to the present embodiment can be obtained. Also, if the material, for example if the material of Fe includes P, a total amount of a content of P in the material of Fe and an amount of P added can be controlled, thereby the amount of P included in the soft magnetic metal particle obtained at the end can be controlled. The water atomizing method can be carried out to the melted material to obtain fine powder. Alternatively, a plurality of materials of Fe having different amount of P may be used to prepare the melted material control to have a content of P within the above range, then the water atomizing method may be carried out to the melted material to obtain fine powder.

Next, using the soft magnetic metal powder obtained as such, the multilayer inductor is produced. The method of producing the multilayer inductor is not particularly limited, and a known method can be used. Hereinafter, the method of producing the multilayer inductor using a sheet method is described.

The obtained soft magnetic metal powder is formed into slurry together with additives such as solvent, binder and the like, thereby a paste is produced. Then, using this paste, the green sheet is formed which becomes the magnetic element body after firing. Here, the soft magnetic metal powders having different particle size may be used to the green sheet for the surface part and the green sheet for the center part. Next, on the green sheet for the part which has been formed, a coil conductor paste is coated to form a coil conductor pattern. Metals (Ag and the like) which become a coil conductor is formed into slurry together with additives such as solvent, binder and the like, thereby the coil conductor paste is produced. Next, a plurality of layers of the green sheets formed with the coil conductor pattern is stacked, then each coil conductor pattern is bonded, thereby a green multilayer body in which the coil conductor is formed three dimensionally and spirally is obtained.

The obtained multilayer body is subjected to a heat treatment (a binder removal step and a firing step), thereby the binder is removed, and the soft magnetic metal particles included in the soft magnetic metal powder become the soft magnetic metal fired particles. Then, the multilayer body as a fired body in which the soft magnetic metal fired particles are connected and fixed to each other (formed as one body) is obtained. A holding temperature at the binder removal step (a binder removal temperature) is not particularly limited as long as the binder can be decomposed and removed as gas, and in the present embodiment, 300 to 450° C. is preferable. Also, a holding time of the binder removal step is not particularly limited (a binder removal time), and in the present embodiment, 0.5 to 2.0 hours is preferable.

A holding temperature at the firing step (firing temperature) is not particularly limited as long as it is a temperature which allows the soft magnetic metal particles constituting the soft magnetic metal powder to connect with each other, and in the present embodiment, 550 to 850° C. is preferable. Also, a holding time of the firing step (a firing time) is not particularly limited, and in the present embodiment, 0.5 to 3 hours is preferable.

Note that, in the present embodiment, atmosphere during the binder removal and the firing are preferably regulated. Specifically, the binder removal and the firing may be carried out under oxidized atmosphere such as under atmospheric atmosphere, and preferably it is carried out under atmosphere having weaker oxidizing power than under atmospheric atmosphere, for example under nitrogen atmosphere or mixed atmosphere of nitrogen and hydrogen. By doing so, the specific resistance of the soft magnetic metal particles can be maintained high, while improving the density of the magnetic element body and improving the magnetic permeability (μ). Also, the Si oxide film can be easily formed to the surface of the soft magnetic metal particles, and oxides of Fe become difficult to form. As a result, the decrease of inductance L caused by the oxidation of Fe can be prevented.

The annealing treatment may be carried out after firing. In case the annealing treatment is carried out, it can be carried out in any condition and for example at 500 to 800° C. for 0.5 to 2.0 hours. Also, the annealing can be carried out under any atmosphere.

Note that, a composition of the soft magnetic metal particles after the above heat treatment substantially matches a composition of the soft magnetic metal powder prior to the above heat treatment.

Next, the terminal electrodes are formed to the element. The method of forming the terminal electrodes is not particularly limited, and usually metals (Ag and the like) which become the terminal electrodes are formed into slurry together with additives such as solvent, binder, and the like.

Next, the resin is impregnated to the element; thereby the resin fills the space. The resin can be impregnated by any method. For example, the method of vacuum impregnation may be mentioned.

The vacuum impregnation is carried out by immersing the above multilayer inductor in the resin and by regulating the air pressure. The resin enters inside of the magnetic element body by decreasing air pressure. Since the space is present from the surface to the inside of the magnetic element body, the resin enters inside of the magnetic element body by capillary phenomenon via the space, and the resin enters into the interlayer part which is the most difficult part to enter, thereby the space is filled with the resin. Then, the resin is cured by heating. The heating condition differs depending on the type of the resin.

Any type of resin can be used, and it is necessary that at the end the resin fills the space. For example, in case of using silicone resin, the resin is present in a film form at the surface of the soft magnetic metal particles particularly in the surface part, and the resin is difficult to sufficiently enter the space inside of the magnetic element body (particularly the interlayer part). Further, silicone resin decomposes when heated at temperature of 300° C. or higher, hence the heat resistance is low. On the contrary to this, particularly in case of using phenol resin or epoxy resin, the resin sufficiently enters to the space inside of the magnetic element body (particularly to the interlayer part), and it easily fills the space sufficiently even after the curing. Further, these resins do not easily decompose by heat hence has a high heat resistance.

The content of the resin in the magnetic element body of the multilayer inductor obtained at the end is preferably 0.5 wt % or more and 3.0 wt % or less. As the amount of the resin used decreases, L increases, and Q becomes smaller and the bending strength tends to decrease. Note that, the content of the resin can be controlled by changing a resin solution concentration, an immersing time, a number of times of immersing, and the like during impregnation.

In the present embodiment, the electroplating can be done to the terminal electrodes after filling the resin. Since the space is filled with the resin, the plating solution scarcely enters inside of the magnetic element body even when the multilayer inductor is introduced into the plating solution. Therefore, a short circuit does not occur in the multilayer inductor even after plating, and the inductance is maintained high.

Hereinabove, the embodiment of the present invention has been described, but the present invention is not to be limited thereto, and it may be modified variously within the scope of the invention.

EXAMPLE

Hereinafter, the present invention is described in detail using examples, but the present invention is not to be limited thereto.

(Experiment 1)

First, Fe and Si were prepared as the raw materials. Next, these were mixed, and placed in a crucible provided in a water atomizing device. Next, under inactive atmosphere, the crucible was heated to 1600° C. or higher by a high frequency induction using a work coil provided outside of the crucible, then an ingot, a chunk, or a shot in the crucible were melted and mixed to obtain a molten metal. Note that, a content of phosphorous was regulated by regulating an amount of phosphorous included in the material of Fe when melting and mixing the material of the soft magnetic metal powder.

Next, a high pressure (50 MPa) of water stream was collided against the molten metal supplied so as to form continuous flow in a line form from a nozzle provided to the crucible, and as a droplet form is formed it is rapidly cooled, then dehydration, drying, and sieving were carried out. Thereby, soft magnetic metal powder made from Fe—Si based alloy particles was produced. Here, two types of soft magnetic metal powders were produced which are the soft magnetic metal powder of the surface part and the soft magnetic metal powder of the center part having different particle size distributions. Note that, a production condition, a sieving condition, and the like were controlled so to attain the particle size distribution shown in Table 1.

As a result of composition analysis of the obtained soft magnetic metal powder using ICP analysis method, the soft magnetic metal powder used in all of the examples and the comparative examples had Fe: 94 mass %, Si: 6 mass %, and a content of P of 350 ppm. Further, other elements besides Fe, Si, and P, such as Cr and the like were not substantially included.

The above soft magnetic metal powder was made into slurry together with additives such as solvent, binder, and the like, thereby the paste was formed. Then the green sheet was formed which becomes the magnetic element body after firing using this paste. A predetermined pattern of Ag conductor (a coil conductor) was formed on this green sheet, and by stacking these, a green multilayer body having a thickness of 0.8 mm was produced.

The obtained green multilayer body was cut into a shape having 2.0 mm×1.2 mm; thereby the green multilayer inductor was obtained. To the obtained multilayer inductor, the binder removal treatment was carried out at 400° C. under inactive atmosphere. Then, the fired body was obtained by firing at 750° C. for 1 hour under reduced atmosphere. Note that, inactive atmosphere refers to $N_2$ gas atmosphere, and reduced atmosphere refers to mixed gas atmosphere of $N_2$ and $H_2$ gas having a hydrogen concentration of 1.0%. To the both end faces of the obtained fired body, the terminal electrode paste was coated and dried, then a printing treatment was carried out at 650° C. for 0.5 hours, thereby the multilayer inductor (a printed product) having terminal electrodes was obtained.

Next, for all of examples and comparative examples except for the comparative example 1, the mixture of the resin material was vacuum impregnated to the obtained printed product, then heated to cure the resin, thereby the resin filled the space of the multilayer inductor. The resin was cured by heating at 150° C. for 2 hours. Note that, the solvent and the like included in the resin mixture was evaporated when curing the resin. The type of the mixture of the resin used for the vacuum impregnation is shown in below Table 1. Note that, a phenol resin A mixture in Table 1 was a mixture having about 50 wt % of phenols ($C_7H_8.CH_2O.\ C_4H_{10}O)_x$, about 38 wt % of ethyleneglycol-monobutylether, about 11 wt % of 1-butanol, about 0.20 wt % of formaldehyde, and about 0.1 wt % of m-cresol, then a phenol resin A was obtained by curing this mixture. A phenol resin B mixture was a mixture having about 50 wt % of phenols $(C_6H_6.CH_2O)_x$, about 1.7 wt % of formaldehyde, about less than 0.3 wt % of methanol, and about 44 wt % of 1-butanol, then a phenol resin B was obtained by curing this mixture. A phenol resin C mixture was a mixture having about 63 wt % of phenols $(C_6H_6O.CH_2O)_x$, about 5.5 wt % of phenol, about 0.60 wt % of formaldehyde, and about 30 wt % of methanol, then a phenol resin C was obtained by curing this mixture. An epoxy resin mixture was a mixture having a naphthalene type epoxy resin, a curing agent, a solvent (toluene), and the like, and then the epoxy resin was obtained by curing this mixture. A silicone resin mixture was a mixture having organopolysiloxane, a solvent (toluene), and the like, and then the silicone resin was obtained by curing this mixture.

Then, the electroplating was carried out, and Ni plating layer and Sn plating layer were formed on the terminal electrodes. Note that, in the comparative example 1, the electroplating was carried out immediately after forming the terminal electrodes, and Ni plating layer and Si plating layer were formed.

For each example and comparative example, an impregnated product of which the resin has cured after the vacuum impregnation and the plated product after the plating were measured using TG-DTA to measure a mass ratio of the resin with respect to the total content of the coil conductor and the magnetic element body. The results are shown in Table 2. Note that, all of examples and comparative examples had substantially no difference in the content ratio of the resin between the impregnated product and the plated product. Further, the composition of the magnetic element body was verified using ICP analysis method, and confirmed that the composition substantially matched with the composition of the soft magnetic metal powder used as the material.

For the impregnated product and the plated product of each example and comparative example, the filling of the space of the interlayer part by the resin was verified. Specifically, the cross section image was taken at a size of 13 μm×10 μm at a magnification of 1000× using SEM, and then the cross section was observed for verification. The results are shown in Table 2. Note that, FIG. 3 to FIG. 5 respectively show SEM images of the interlayer part of the printed product, the impregnated product, and the plated product of the example 1. FIG. 6 is SEM image of the plated product of the comparative example 1, FIG. 7 is SEM image of the impregnated product of the comparative example 2, and FIG. 8 is SEM image of the plated product of the comparative example 2.

For the interlayer part and the surface part of each example and comparative example, an area ratio of the space was measured. Specifically, for the impregnated product of each example and comparative example, the embedding resin for polishing was embedded, then observed at a size of 62 μm×44 μm under a magnification of 2000× using SEM-EDS, and an area where C exist was defined as the space and an area ratio was calculated with respect to 100% of total of Fe, Si, O, and C. The results are shown in Table 1. Note that, the area ratio of the space shown in Table 1 is an average of the area ratio calculated from the 30 multilayer inductors for each example and comparative example.

Note that, FIG. 9 was BF image of the example 1, and FIG. 10 was HADDF image of the example 1.

Further, using STEM-EDS, a size of 7 μm×7 μm was observed under magnification of 20000× which was higher magnification than the above measurement, and verified that Si substantially did not exist except for the oxide film. Also, all of examples were confirmed to have the soft magnetic metal particle core and the Si oxide film contacting the soft magnetic metal particle core.

For the multilayer inductor of each example and comparative example, L and Q were measured using LCR meter (4285A made by HEWLETT PACKARD) at f=2 MHz and I=0.1 A. The results are shown in Table 2. Note that, L and Q shown in Table 2 were an average of L and Q calculated from 30 multilayer inductors for each example and comparative example. In the present example, when L was 0.30 μH or more, it was considered good; and when L was 0.4 or more, it was considered even better. Also, when Q was 30 or more, it was considered good, and if Q was 40 or more, then it was considered even better.

For the multilayer inductor of each example and comparative example, a number of short circuits were counted. The number of short circuit of the impregnated products and the plated products (30 products for each) of each example and comparative example were verified using LCR meter. Among these 30 products, the number of multilayer inductor which had short circuit was counted. The results are shown in Table 2. In the present embodiment, zero short circuit was considered good.

For the multilayer inductor of each example and comparative example, the bending strength was measured. The bending strength was measured using a bonding strength tester (CPU GAUGE 9500 SERIES made by AIKOH ENGINEERING CO., LTD) at 10 mm/min. The results are shown in Table 2. Note that, the results shown in Table 2 were the average of the measured bending strength of 10 multilayer inductors. In the present example, when the bending strength was more than 30.0 N, it was considered good, and when it was more than 45.0 N, and then it was considered even better.

TABLE 1

| | | | Particle size distribution (μm) | | | | | | | | | | Area ratio of space part (%) | |
|---|---|---|---|---|---|---|---|---|---|---|---|---|---|---|
| | | | Center part | | | | | Surface part | | | | | | |
| | Resin | Step | D10 | D50 | D90 | D50 − D10 | D90 − D50 | D10 | D50 | D90 | D50 − D10 | D90 − D50 | Interlayer part | Surface part |
| Example 1 | Phenol resin A | Infiltrated product<br>Plated product | 2.5 | 5.0 | 9.5 | 2.5 | 4.5 | 3.5 | 7.5 | 14.5 | 4.0 | 7.0 | 25 | 29 |
| Example 2 | Phenol resin B | Infiltrated product<br>Plated product | | | | | | | | | | | | |
| Example 3 | Phenol resin C | Infiltrated product<br>Plated product | | | | | | | | | | | | |
| Comparative example 1 | None | Plated product | | | | | | | | | | | | |
| Comparative example 2 | Silicone resin | Infiltrated product<br>Plated product | | | | | | | | | | | | |
| Example 3a | Epoxy resin | Infiltrated product<br>Plated product | | | | | | | | | | | | |

TABLE 1-continued

| | | | Particle size distribution (μm) | | | | | | | | | | Area ratio of space part (%) | |
|---|---|---|---|---|---|---|---|---|---|---|---|---|---|---|
| | | | Center part | | | | | Surface part | | | | | | |
| | Resin | Step | D10 | D50 | D90 | D50 − D10 | D90 − D50 | D10 | D50 | D90 | D50 − D10 | D90 − D50 | Interlayer part | Surface part |
| Example 4 | Phenol resin A | Infiltrated product | | | | | | | | | | | 10 | 15 |
| | | Plated product | | | | | | | | | | | | |
| Example 5 | Phenol resin A | Infiltrated product | | | | | | | | | | | 35 | 40 |
| | | Plated product | | | | | | | | | | | | |
| Example 6 | Phenol resin A | Infiltrated product | 0.5 | 1.0 | 2.5 | 0.5 | 1.5 | 3.5 | 7.5 | 14.5 | 4.0 | 7.0 | 15 | 29 |
| | | Plated product | | | | | | | | | | | | |
| Example 7 | Phenol resin A | Infiltrated product | 2.5 | 5.0 | 9.5 | 2.5 | 4.5 | 4.0 | 10.0 | 22.0 | 6.0 | 12.0 | 25 | 35 |
| | | Plated product | | | | | | | | | | | | |
| Example 8 | Phenol resin A | Infiltrated product | 2.5 | 5.0 | 9.5 | 2.5 | 4.5 | 3.5 | 7.5 | 14.5 | 4.0 | 7.0 | 25 | 29 |
| | | Plated product | | | | | | | | | | | | |
| Example 9 | Phenol resin A | Infiltrated product | | | | | | | | | | | | |
| | | Plated product | | | | | | | | | | | | |

TABLE 2

| | Resin | Step | Space of interlayer part filled with resin | Mass ratio of resin (mass %) | Short circuit (number/thirty) | L (μH) | Q | Bending strength (N) |
|---|---|---|---|---|---|---|---|---|
| Example 1 | Phenol resin A | Infiltrated product | Filled | 1.7 | 0 | 0.47 | 48.0 | 56.0 |
| | | Plated product | Filled | | 0 | 0.47 | 47.3 | 54.2 |
| Example 2 | Phenol resin B | Infiltrated product | Filled | 2.0 | 0 | 0.46 | 47.2 | 56.5 |
| | | Plated product | Filled | | 0 | 0.46 | 46.0 | 55.3 |
| Example 3 | Phenol resin C | Infiltrated product | Filled | 2.0 | 0 | 0.46 | 47.5 | 57.3 |
| | | Plated product | Filled | | 0 | 0.46 | 46.5 | 55.0 |
| Comparative example 1 | None | Plated product | Not filled | 0 | 30 | 0.06 | 0.3 | 16.0 |
| Comparative example 2 | Silicone resin | Infiltrated product | Not filled | 0.3 | 0 | 0.46 | 37.2 | 18.4 |
| | | Plated product | Not filled | | 30 | 0.23 | 1.2 | 15.0 |
| Example 3a | Epoxy resin | Infiltrated product | Filled | 2.0 | 0 | 0.45 | 49.0 | 60.0 |
| | | Plated product | Filled | | 0 | 0.45 | 48.0 | 57.0 |
| Example 4 | Phenol resin A | Infiltrated product | Filled | 1.0 | 0 | 0.52 | 46.0 | 45.0 |
| | | Plated product | Filled | | 0 | 0.52 | 45.5 | 43.5 |
| Example 5 | Phenol resin A | Infiltrated product | Filled | 2.8 | 0 | 0.42 | 51.5 | 60.5 |
| | | Plated product | Filled | | 0 | 0.42 | 50.3 | 58.6 |
| Example 6 | Phenol resin A | Infiltrated product | Filled | 1.2 | 0 | 0.30 | 40.0 | 55.0 |
| | | Plated product | Filled | | 0 | 0.30 | 38.2 | 53.0 |
| Example 7 | Phenol resin A | Infiltrated product | Filled | 2.2 | 0 | 0.60 | 44.0 | 50.3 |
| | | Plated product | Filled | | 0 | 0.60 | 43.6 | 48.0 |
| Example 8 | Phenol resin A | Infiltrated product | Filled | 0.5 | 0 | 0.49 | 45.0 | 33.0 |
| | | Plated product | Filled | | 0 | 0.49 | 43.0 | 32.0 |
| Example 9 | Phenol resin A | Infiltrated product | Filled | 3.0 | 0 | 0.44 | 50.0 | 62.0 |
| | | Plated product | Filled | | 0 | 0.44 | 49.0 | 60.0 |

According to Table 1 and Table 2, for the examples 1 to 9 which used phenol resin or epoxy resin as the resin, the space of the interlayer part which was the most difficult part to fill was filled with the resin. As a result, the short circuit did not occur even after plating, and L and Q were maintained high. Further, the bending strength was increased as well.

On the contrary to this, the plated product of Comparative example 1 which did not use the resin had short circuit in all of the plated products. Further, L and Q were significantly low, and also the bending strength was low as well. Further, the comparative example 2 impregnated with the silicone resin was unable to fill the resin sufficiently, and particularly from SEM image of the interlayer part, it was unable to confirm that the space was filled with the resin. As a result, the plating solution entered into the space and short circuit occurred in the plated product. Also, the plated product had significantly low L and Q compared to the impregnated product. Further, as the resin was not filled sufficiently, the bending strength was significantly low.

Further, a high accelerated life test and a humidity resistance test were carried out. The highly accelerated life test was carried out to verify whether the multilayer inductor (plated product) of each example and comparative example had decreased L and Q by 10% or less after applying 2.1 A current at 85° C. for 2000 hours. The humidity resistance test was verified to carry out whether the multilayer inductor (the plated product) of each example and comparative example had decreased L and Q by 10% or less after applying 2.1 A current at 85° C. and 85% humidity for 2000 hours. All of the examples showed good results in regards with the highly accelerated life test and the humidity resistance test.

(Experiment 2)

In Experiment 2, the heat treatment was carried out at 220 to 340° C. for five minutes to the multilayer inductor (plated product) of Examples 1 to 3 and 3a. Then, as similar to Experiment 1, the number of short circuit, L, Q, and the bending strength were evaluated. The results are shown in Table 3.

TABLE 3

| | Resin | Heat treatment temperature (° C.) | Short circuit (number/thirty) | L (μH) | Q | Bending strength (N) |
|---|---|---|---|---|---|---|
| Example 1 | Phenol resin A | N/A | 0 | 0.47 | 47.3 | 54.2 |
| | | 220 | 0 | 0.47 | 46.5 | 52.2 |
| | | 240 | 0 | 0.47 | 46.3 | 50.9 |
| | | 260 | 0 | 0.47 | 46.6 | 50.7 |
| | | 280 | 0 | 0.47 | 46.0 | 51.2 |
| | | 300 | 0 | 0.47 | 45.7 | 49.3 |
| | | 320 | 0 | 0.47 | 45.8 | 42.5 |
| | | 340 | 0 | 0.47 | 45.2 | 33.8 |
| Example 2 | Phenol resin B | N/A | 0 | 0.46 | 46.0 | 55.3 |
| | | 220 | 0 | 0.46 | 45.5 | 53.5 |
| | | 260 | 0 | 0.46 | 45.7 | 51.2 |
| | | 300 | 0 | 0.46 | 45.0 | 50.0 |
| | | 340 | 0 | 0.46 | 44.8 | 37.8 |
| Example 3 | Phenol resin C | N/A | 0 | 0.46 | 46.5 | 55.0 |
| | | 220 | 0 | 0.46 | 46.2 | 54.5 |
| | | 260 | 0 | 0.46 | 45.5 | 53.2 |
| | | 300 | 0 | 0.46 | 45.0 | 52.5 |
| | | 340 | 0 | 0.46 | 44.5 | 40.5 |
| Example 3a | Epoxy resin | N/A | 0 | 0.45 | 48.0 | 57.0 |
| | | 220 | 0 | 0.45 | 47.5 | 58.5 |
| | | 260 | 0 | 0.45 | 47.1 | 57.2 |
| | | 300 | 0 | 0.45 | 46.5 | 53.5 |
| | | 340 | 0 | 0.45 | 45.5 | 43.0 |

The multilayer inductors (plated products) of Examples 1 to 3 which were impregnated with phenol resin and the multilayer inductor (plated product) of Example 3a which was impregnated with epoxy resin did not have short circuit, and L and Q were good. Also, the bending strength decreased when the heat treatment temperature was higher than 300° C. compared to the heat treatment temperature of 300° C. or less, but the bending strength was maintained within the above range which showed good result. Note that, the reason for the decrease of the bending strength when the heat treatment temperature was higher than 300° C. is thought to be caused because part of the resin evaporates by heat.

Figure 12:
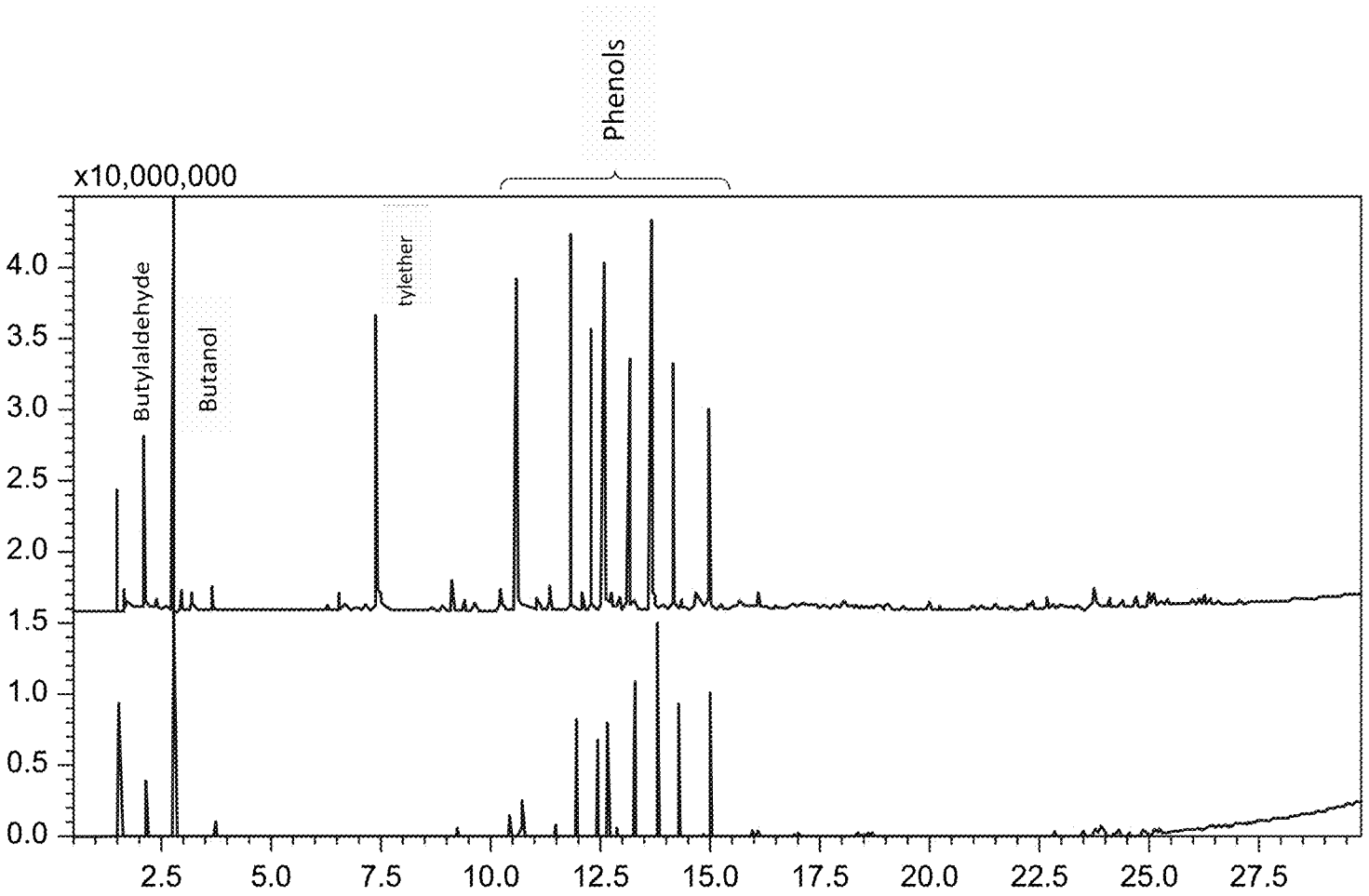
FIG. 12 is GC-MS analysis result of Example 1.

Note that, FIG. 12 shows the results of GC-MS analysis of the phenol resin A included in the examples obtained by curing the phenol resin A mixture after impregnating the phenol resin A mixture to the multilayer inductor, and GC-MS analysis of the phenol resin A obtained by curing only the phenol resin A mixture.

In case of carrying out GC-MS analysis of the phenol resin A obtained by curing after impregnating to the multilayer inductor, specifically the multilayer inductor was cut in half using knife, and placed in eco-cup (metal container), then heat decomposition was carried out for 6 seconds at 600° C. In case of carrying out GC-MS analysis only to the phenol resin A, specifically the phenol resin A mixture was cured alone at first to obtain the phenol resin A. Then, only the phenol resin A was placed in eco-cup (metal container), then heat decomposition was carried out for 6 seconds at 600° C. Note that, GC-MS analysis was carried out by device: GCMS-QP2010 made by Shimadzu Corporation, heat decomposition unit: Double Shot Pyrolyzer (Flontier Lab Py2020iD), GC: carrier gas of He, sprit ratio of 20:1 (50 kPa, total flow amount 24 mL/min, column used: Ultra Alloy-5 (0.25 mm*30 m), temperature profile: 40° C. (3 min)-10° C./min-300° C. (15 min), MS: Scan mode, m/z=33-500 m, and detection voltage 1.1 V. An upper graph shown in FIG. 12 is a result of GC-MS analysis of the phenol resin A included in the multilayer inductor produced under the same condition as Example 1 except for impregnating in the phenol resin A mixture for twice, and curing for 2 hours at 150° C. A lower graph shown in FIG. 12 is a result of GC-MS analysis after curing only the phenol resin A mixture for 2 hours at 150° C. In below Table 4, a peak (value disclosed in literature) of each speculated compound included in the phenol resin A and the solvent of the phenol resin A mixture are shown. According to FIG. 12 and Table 4, the phenol resin A was included in the multilayer inductor of Example 1.

TABLE 4

| Time (min) | Speculated compound |
|---|---|
| 2.105 | Butylaldehyde |
| 2.714 | Butanol |
| 7.388 | Ethyleneglycolmonobutylether |
| 9.091 | trimethylbenzene |
| 10.55 | methylphenol(cresol) |
| 11.757 | dimethylphenol |
| 12.198 | dimethylphenol |
| 12.445 | dimethylphenol |
| 13.045 | Trimethylphenol |
| 13.555 | Trimethylphenol |
| 14.049 | Trimethylphenol |
| 14.881 | Tetramethylphenol |

REFERENCES OF NUMERALS

1 . . . Multilayer inductor
2 . . . Element
2*a* . . . Surface part
2*b* . . . Center part
3 . . . Terminal electrode
4 . . . Magnetic element body
4*a* . . . Interlayer part
5 . . . Coil conductor
5*a*, 5*b* . . . Extracting electrode
11 . . . Soft magnetic metal particle
11*a* . . . Soft magnetic metal particle core
11*b* . . . Oxide film
12 . . . Space
13 . . . Resin
14 . . . Space

What is claimed is:

1. A multilayer coil electronic component comprising an element in which a coil conductor and a magnetic element body are laminated, wherein the magnetic element body includes soft magnetic metal particles and a resin, the resin fills a space between the soft magnetic metal particles, each of the soft magnetic metal particles comprises:

a soft magnetic metal particle core, in which the soft magnetic metal particle core is an Fe—Si alloy and does not include substantially Cr, a content of Si in the soft magnetic metal particle core is 3.0 parts by mass or more; and an oxide film, in which the oxide film covers the soft magnetic metal particle core and is formed by oxidation of the soft magnetic metal particle core, a layer of the oxide film contacting the soft magnetic metal particle core is made of an oxide including Si, a content of P in the soft magnetic metal particle core is 0.011 parts by mass or more and 0.065 parts by mass or less with respect to 100 parts by mass of a total content of Fe and Si in the soft magnetic metal particle core, and an average thickness of the oxide film is 5 nm or more and 60 nm or less.

2. The multilayer coil electronic component according to claim 1, wherein the oxide including Si is substantially included only in the oxide film.

3. The multilayer coil electronic component according to claim 1, wherein an area ratio of the space is 10.0% or more and 35.0% or less with respect to an entire SEM image obtained by observing a cross section of an interlayer part of the multilayer coil electronic component by SEM.

4. The multilayer coil electronic component according to claim 1, wherein D50–D10 of the soft magnetic metal particles is 3.0 μm or less and D90–D50 is 4.5 μm or less at an interlayer part of the multilayer coil electronic component.

5. The multilayer coil electronic component according to claim 1, wherein a content of other elements except for Fe, Si, and O in the soft magnetic metal particle core is 0.15 parts by mass or less with respect to 100 parts by mass of the total content of Fe and Si.

6. The multilayer coil electronic component according to claim 1, wherein the resin is a phenol resin or an epoxy resin.

7. The multilayer coil electronic component according to claim 1, wherein a mass ratio of the resin with respect to a total mass of the coil conductor and the magnetic element body is 0.5 mass % or more and 3.0 mass % or less.

8. A multilayer coil electronic component comprising an element in which a coil conductor and a magnetic element body are laminated, wherein the magnetic element body includes soft magnetic metal particles and a resin, the resin fills a space between the soft magnetic metal particles, each of the soft magnetic metal particles comprises:

a soft magnetic metal particle core; and an oxide film, in which the oxide film covers the soft magnetic metal particle core and is formed by oxidation of the soft magnetic metal particle core, a content of Fe in the soft magnetic metal particle core is 92.5 parts by mass or more and 97.0 parts by mass or less with respect to 100 parts by mass of a total content of Fe and Si in the soft magnetic metal particle core, a content of Si in the soft magnetic metal particle core is 3.0 parts by mass or more and 7.5 parts by mass or less with respect to 100 parts by mass of the total content of Fe and Si, a content of P in the soft magnetic metal particle core is 0.011 parts by mass or more and 0.065 parts by mass or less with respect to 100 parts by mass of the total content of Fe and Si, Cr is substantially not included in the soft magnetic metal particle core, and an average thickness of the oxide film is 5 nm or more and 50 nm or less.

9. The multilayer coil electronic component according to claim 8, wherein an area ratio of the space is 10.0% or more and 35.0% or less with respect to an entire SEM image obtained by observing a cross section of an interlayer part of the multilayer coil electronic component by SEM.

10. The multilayer coil electronic component according to claim 8, wherein D50–D10 of the soft magnetic metal particles is 3.0 μm or less and D90–D50 is 4.5 μm or less at an interlayer part of the multilayer coil electronic component.

11. The multilayer coil electronic component according to claim 8, wherein the soft magnetic metal particle core is an Fe—Si alloy, and a content of other elements except for Fe, Si and O in the soft magnetic metal particle core is 0.15 parts by mass or less with respect to 100 parts by mass of the total content of Fe and Si.

12. The multilayer coil electronic component according to claim 8, wherein the resin is a phenol resin or an epoxy resin.

13. The multilayer coil electronic component according to claim 8, wherein a mass ratio of the resin with respect to a total mass of the coil conductor and the magnetic element body is 0.5 mass % or more and 3.0 mass % or less.

* * * * *